US006095187A

United States Patent [19]

Hotchkiss

[11] Patent Number: 6,095,187

[45] Date of Patent: Aug. 1, 2000

[54] SOLENOID-ACTUATED ZERO-LEAKAGE FAIL-SAFE THREE-POSITION POPPET-STYLE FOUR-WAY HYDRAULIC DIRECTIONAL CONTROL VALVE

[75] Inventor: Thomas W. Hotchkiss, Orange, Conn.

[73] Assignee: Interface Devices, Inc., Milford, Conn.

[21] Appl. No.: 09/187,126

[22] Filed: Nov. 5, 1998

[51] Int. Cl.[7] ..... F15B 13/044

[52] U.S. Cl. ..... 137/596.17; 91/420; 137/596.2

[58] Field of Search ..... 91/420; 137/596.17, 137/596.2

[56] References Cited

U.S. PATENT DOCUMENTS

| | | | |
|---|---|---|---|
| 3,736,958 | 6/1973 | Rostad | 137/625.6 |
| 4,461,314 | 7/1984 | Kramer | 91/420 X |
| 4,494,572 | 1/1985 | Loveless | 137/596.17 |
| 4,526,202 | 7/1985 | Chorkey | 137/625.66 |
| 4,574,844 | 3/1986 | Neff et al. | 137/625.65 |
| 4,791,960 | 12/1988 | Ellison | 137/596.17 |
| 4,842,020 | 6/1989 | Timholt | 137/625.65 |
| 4,971,115 | 11/1990 | Timholt | 137/625.65 |
| 5,136,929 | 8/1992 | Kervagoret | 91/420 |
| 5,214,997 | 6/1993 | Lebret | 91/420 |
| 5,263,513 | 11/1993 | Roe | 137/627.5 |
| 5,349,818 | 9/1994 | McFadyen et al. | 91/420 X |

*Primary Examiner*—Gerald A. Michalsky
*Attorney, Agent, or Firm*—Brown, Pinnisi & Michaels, P.C.

[57] ABSTRACT

A solenoid-actuated zero-leakage fail-safe three-position poppet-style four-way hydraulic directional control valve includes an arrangement whereby the inlet pressure P is connected to the inlet ports of first and second normally closed 2-way poppet solenoid valves. The outlets of first and second poppet solenoid valves are connected to the A and B load ports, respectively. The A and B ports are respectively connected to the checked port of first and second pilot-operated check valves (POCVs) whose outlets are connected to the tank port T. The pilot ports of the POCVs are cross connected from A to B and from B to A. When the solenoid for the first poppet solenoid valve is energized, the first poppet solenoid valve opens, admitting pressure to port A. Pressure is blocked to the tank port by the first POCV. Simultaneously, the pilot pressure from the A-line opens the second POCV, thereby connecting the B port to tank. If power fails, pressure is maintained in the A-line and the B-line remains connected to tank. Due to the design of the directional control valve, internal leakage is 5 drops per minute at a maximum operating pressure of 6,000 psi (414 bar) while supporting a high flow of 3.0 gpm (11.4 lpm) nominal.

5 Claims, 6 Drawing Sheets

SOLENOID-ACTUATED ZERO-LEAKAGE FAIL-SAFE THREE-POSITION POPPET-STYLE FOUR-WAY HYDRAULIC DIRECTIONAL CONTROL VALVE

FIELD OF THE INVENTION

The invention pertains to the field of four-way hydraulic directional control valves, and in particular, to a four-way hydraulic directional control valve that is poppet style and solenoid actuated.

BACKGROUND OF THE INVENTION

The purpose of any four-way hydraulic directional control valve is to direct the flow and pressure from a uni-directional input device, such as a pump, to a bi-directional output device, such as a cylinder, to cause it to alternately extend and retract, thus moving or holding an external load in either or both directions of travel. At the same time, the valve directs the return flow of hydraulic fluid from the unpressurized end of the cylinder to the hydraulic reservoir.

Typical valve designs include balanced spool, shear-seal slide, and poppet. The balanced spool design is one in which a hydraulically balanced spool with undercuts is positioned axially within a fixed sleeve with internal under-cuts to provide the desired flow patterns. A major advantage is that only a very low force is required to move the spool since it is pressure balanced. A major disadvantage is that, due to necessary spool-to-sleeve clearance, inter-port leakage is unacceptable in high pressure holding applications.

The shear-seal slide design has a flat faced slide block with internal porting positioned axially along the top of four inline pressure loaded shoes (P,T,A,B). A major advantage of this design is that there is virtually no inter-port leakage due to pressure loaded shoes in contact with the face of the slide, both of which are lapped flat. Roller bearings on top of the slide prevent the slide from lifting while minimizing axial slide force. A major disadvantage is that a large force is required to position the slider due to friction between the shoes and the slide block.

The poppet design has multiple poppets (balls) that are urged on or off their seats to block flow or allow flow past their seats. A major advantage is that there is virtually no inter-port leakage due to the design of the poppet on the seat. A major disadvantage is that existing designs are unnecessarily complex and therefore costly.

Common methods of valve actuation include mechanical (manual knob, lever, cam follower, etc.), remote air or hydraulic pilot pressure, and electric solenoid. A solenoid is an electromechanical device which converts electric power into linear mechanical force and motion. Its counterpart in a hydraulic system is a cylinder.

Standard valve input/output port identification is used. The "P" port supplies pressure from the pump. The "T" port handles the return flow from the valve to the tank or hydraulic reservoir. The "A" port is the cylinder port to either the "head-end" or the "rod-end" of the hydraulic cylinder, while the "B" port is the cylinder port to the other end of the cylinder.

Examples of the prior art include U.S. Pat. No. 3,736,958, Four Way Solenoid Selector Valve (Rostad et al.). This is a 3 position, spring-centered, balanced spool (high leakage) design pilot-operated by two 3-way poppet solenoid valves using control orifices and metering lands for controlled (slow, non-shock) shifting of the spool. It is not a zero leakage valve. It is not fail safe for either loss of electrical power to either solenoid or loss of "P-port" pressure.

U.S. Pat. No. 4,574,844, Four Way Poppet Valve (Neff and Fagerlie) discloses a 2 position, direct-acting (as opposed to pilot operated), spring offset, balanced spool with fixed elastomeric poppets at each spool land face to provide a zero leakage 4-way, single solenoid operated valve. It is a low pressure pneumatic valve, unsuitable for high pressure operation because the elastomeric poppets would extrude into the gap between the spool and the housing and eventually blow out or get sheared off. Further, the distance between the poppet faces and the seat faces need only to be approximately equal because compression of the poppets would make up for small differences and still maintain zero-leakage. If the poppets were metal (for high pressure sealing), the gaps would have to be made and maintained exactly equal. It is not fail safe for either loss of electrical power to either solenoid or loss of "P-port" pressure.

U.S. Pat. No. 4,842,020, Double Solenoid Single-Stem Four-Way Valve, (Tinholt) discloses a 2 position, direct-acting, double solenoid, unbalanced spool design with a fixed elastomeric poppet mid-span on the spool (seals "pressure" to the selected "load port") and elastic 2 "load ports to O-rings near each end of the spool. It provides a zero leakage 4-way double solenoid valve. exhaust ports". It is a low pressure pneumatic valve, unsuitable for high pressure operation for the same reasons as the Neff patent described above. Additionally, the force required to shift the spool would be unacceptable at high pressure due to both the unbalanced force and the force required to push the O-ring (s) into the spool bore. It is fail-safe due to loss of electrical power to either solenoid, but is not fail safe due to loss of pressure.

U.S. Pat. No. 4,971,115, Four-Way Poppet Valve With Hollow Stem & 4 Port Body, (Tinholt) discloses a 2 position, direct-acting (as opposed to pilot operated), spring offset, balanced spool with fixed elastomeric poppets at each spool land face to provide a zero leakage 4-way, single solenoid operated valve. It is a low pressure pneumatic valve, unsuitable for high pressure operation because the elastomeric poppets would extrude into the gap between the spool and the housing and eventually blow out or get sheared off. Further, the distance betweer the poppet faces and the seat faces need only to be approximately equal because compression of the poppets would make up for small differences and still maintain zero-leakage. If the poppets were metal (for high pressure sealing), the gaps would have to be made and maintained exactly equal. It is not fail safe for either loss of electrical power to either solenoid or loss of "P-port" pressure.

U.S. Pat. No. 5,263,513, Dual Flow Passage Poppet Valve, (Roe) discloses a 2 position, direct-acting, double solenoid, unbalanced multi-poppet design. While the 4 metal-to-metal poppets and seats could classify this as a zero leakage valve, the poppets 146, 148 poppets are sliding fits within the housing 102 and provide two constant leak paths from Pressure to Tank. Should a pair of seals be installed between the poppets and housing, the solenoid force to shift the poppet assemblies would be prohibitive when coupled with the unbalanced poppet design. It is fail-safe due to loss of electrical power to either solenoid, but is not fail safe due to loss of pressure.

U.S. Pat. No. 4,494,572, Four-Way Poppet Valve Assembly, (Loveless) discloses a 2 position, direct-acting, spring offset, lightly unbalanced spools with fixed elastomeric poppets at each spool land face to provide a zero leakage 4-way, single solenoid operated valve. It is a low pressure pneumatic valve, unsuitable for high pressure operation because the elastomeric poppets would extrude into the gap between the spool and the housing and eventually blow out or get sheared off. Should the poppets be made of metal, the unbalanced spool force would have to be increased significantly to maintain its claimed zero-leakage, thus requiring an unacceptable increase in the force (size) of the solenoid and return spring. It is not fail safe for either loss of electrical power to either solenoid or loss of "P-port" pressure.

U.S. Pat. No. 4,791,960, Semi-Pilot Operated Four Way Valve, (Ellison) discloses a 3-way pilot operated poppet valve whose two positions are established by a pressure unbalanced spool, driven by another small direct acting single solenoid, spring offset 3-way valve, which is also used to direct the main flow of the valve to accomplish a 4 way function. It is very flow restrictive because the main flow to and from the second load port must not only pass through the small 3-way pilot valve, but also through a fixed restrictor in the second load port line. The restrictor is necessary to insure sufficient pilot pressure is available to pilot piston 18. This is a low pressure pneumatic valve, unsuitable for high pressure operation because the elastomeric poppets would extrude into the gap between the spool and the housing and eventually blow out or get sheared off. Should the poppets be made of metal, the unbalanced spool force would have to be increased significantly to maintain its claimed zero-leakage, thus requiring an unacceptable increase in the force (size) of the solenoid and return spring. It is not fail safe for either loss of electrical power to either solenoid or loss of "P-port" pressure.

U.S. Pat. No. 4,526,202, Valve With Straight Through Flow, (Chorkey) discloses a single-shoe shear seal design using a flexible conduit fixed at one end (inlet "P" port) to minimize the number of shoes and allow for straight through flow. It is shown to be able to be actuated in several ways: (a) single remote 3-way pilot valve, spring offset, 2 position (piloted from either end); (b) single, direct-acting solenoid, spring offset, 2 position; and (c) double remote 3-way pilot valves, 2 or 3 position. It is a low pressure pneumatic valve, unsuitable for high pressure operation for the following reasons:

(1) the flexible conduit would have to be too rigid (inflexible) to accommodate the high pressure and therefore require a very large force to shift the slider shoe; (2) the high pressure flexible conduit end attachments would have to be too large to be practical; and (3) the pressure loading of the shoe to the slider would have to be substantially increased to minimize leakage, adding further to the need for high forces required to shift the valve. It is not fail safe for loss of power to either the direct acting solenoid or the remote pilot valve(s). Further, it is not fail safe with the loss of "P-port" pressure.

Poppet valve BE4904 manufactured by Wandfluh of America, Inc. is very complex, requiring four 2-way poppet solenoid valves to yield a 4-way function. Pairs of coils must be energized to cause the cylinder to extend or retract. The 4-way Closed Centre Poppet Valve model GGS02-50/51 manufactured by Sterling Hydraulics suffers the same drawbacks.

The Model M-SED 6, Series 1X Directional Poppet Valves with Solenoid Operation manufactured by Mannesmann Rexroth are also very complex. Two 3-way poppet valves are required, with one being solenoid operated and the other being hydraulic pilot operated. The valves are not fail-safe. That is, due to the single solenoid-spring offset operation, if electrical power is lost, pressure to the cylinder is lost. An additional disadvantage is that a relatively high wattage coil is required to hold the poppet on its seat.

The directional seated valves manufactured by Carr Lane Roemheld Mfg. Co. are likewise complex. Two 3-way poppet solenoid valves are required to yield a 4-way function. The valves are not fail-safe due to their dual solenoid-spring offset function. If electrical power is lost, the pressure to the cylinder is lost.

SUMMARY OF THE INVENTION

Briefly stated, a solenoid-actuated zero-leakage fail-safe three-position poppet-style four-way hydraulic directional control valve includes an arrangement whereby the inlet pressure P is connected to the inlet ports of first and second normally closed 2-way poppet solenoid valves. The outlets of first and second poppet solenoid valves are connected to the A and B load ports, respectively. The A and B ports are respectively connected to the checked port of first and second pilot-operated check valves (POCVs) whose outlets are connected to the tank port T. The pilot ports of the POCVs are cross connected from A to B and from B to A. When the solenoid for the first poppet solenoid valve is energized, the first poppet solenoid valve opens, admitting pressure to port A. Pressure is blocked to the tank port by the first POCV. Simultaneously, the pilot pressure from the A-line opens the second POCV, thereby connecting the B port to tank. If power fails, pressure is maintained in the A-line and the B-line remains connected to tank. Due to the design of the directional control valve, internal leakage is 5 drops per minute at a maximum operating pressure of 6,000 psi (414 bar) while supporting a high flow of 3.0 gpm (11.4 lpm) nominal.

According to an embodiment of the invention, a four-way hydraulic directional control valve includes a valve body having a pressure supply port, a tank port, and first and second load ports; first and second normally-closed 2-way poppet solenoid valves mounted to the valve body; first and second normally-closed pilot-operated check valves mounted within the valve body; the pressure supply port being connected to both an inlet port of the first poppet solenoid valve and an inlet port of the second poppet solenoid valve; the first load port being connected to an outlet port of the first poppet solenoid valve and the second load port being connected to an outlet of the second poppet solenoid valve; the first load port being connected to a checked port of the first check valve and the second load port being connected to a checked port of the second check valve; and the first load port being connected to a pilot port of the second check valve and the second load port being connected to a pilot port of the first check valve.

DESCRIPTION OF THE PREFERRED EMBODIMENT

Figure 1:
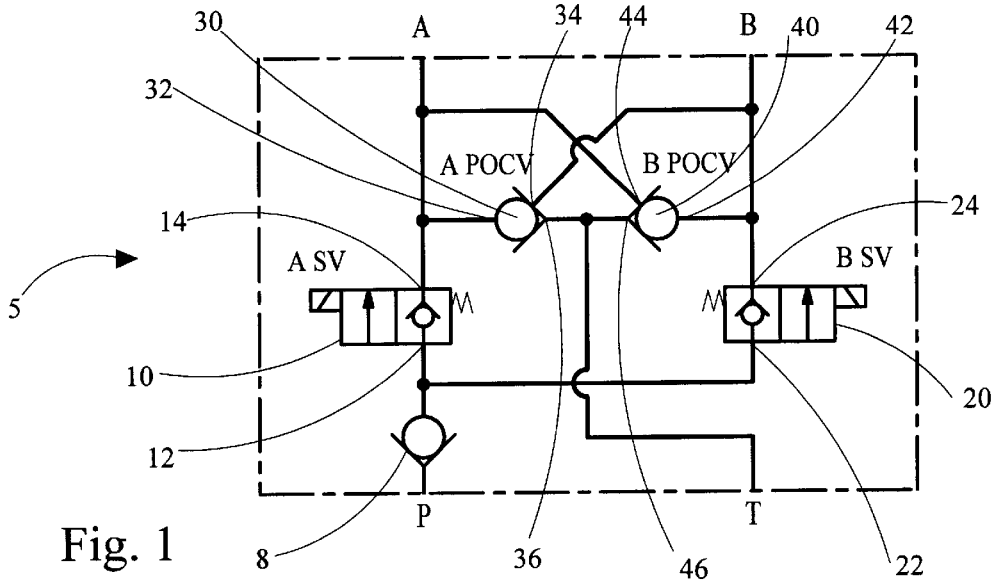
FIG. 1 shows a schematic used to explain the 4-way hydraulic directional control valve of the present invention.

Referring to FIG. 1, a hydraulic control valve 5 is shown. The P port is connected through an optional check valve 8 to an inlet port 12 of a normally closed 2-way poppet solenoid first valve 10 and an inlet port 22 of a normally closed 2-way poppet solenoid second valve 20. Valves 10, 20 are preferably of the style exemplified by the SV58-22 manufactured by HydraForce, which optionally include a manual override option as is standard in the industry. An outlet port 14 of first valve 10 is connected to the A port while an outlet port 24 of second valve 20 is connected to the B port.

The A port is connected to a checked port 32 of a pilot operated control valve (POCV) 30. The B port is connected to a checked port 42 of a POCV 40. An outlet 36 of POCV 30 and an outlet 46 of POCV 40 are connected to the T port. A pilot port 34 of POCV 30 is cross-connected to the B port while a pilot port 44 of POCV 40 is cross-connected to the A port.

In operation, when the solenoid of first valve 10 is energized, valve 10 opens, thereby admitting pressure (flow) from inlet pressure P to port A. The pressure (flow) is blocked to tank port T by POCV 30. Simultaneously, the pressure from port P via the pressurized A-line opens POCV 40 via pilot port 44, thereby connecting the B port pressure to the T port. If power fails, pressure is maintained in the A-line while the B-line remains open to tank. The user's electrical logic should not allow both solenoids to be energized at the same time.

Figure 2:
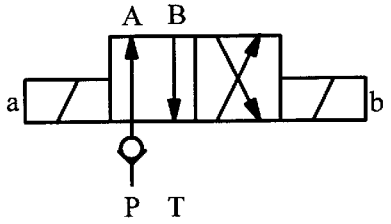
FIG. 2 shows a schematic of the valve of the present invention.
Figure 3:
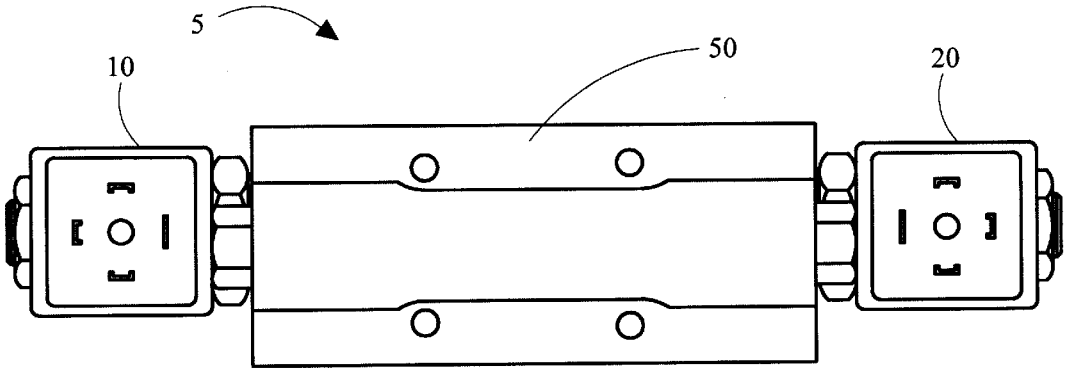
FIG. 3 shows a top view of the valve of the present invention.
Figure 4:
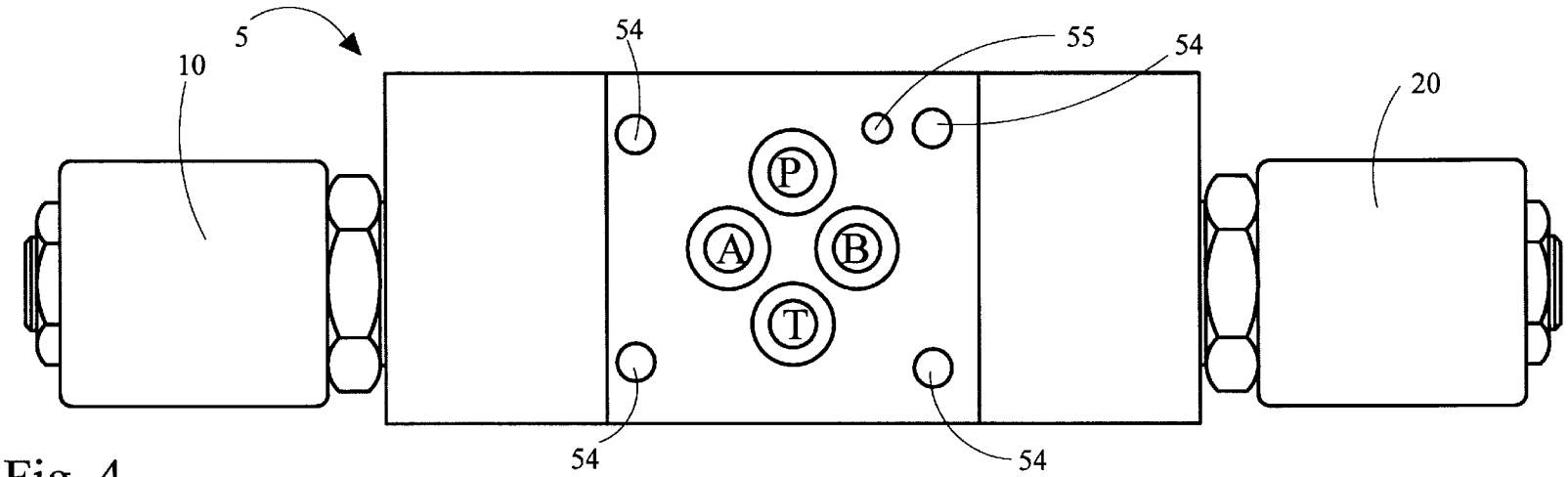
FIG. 4 shows a bottom view of the valve of the present invention.
Figure 5:
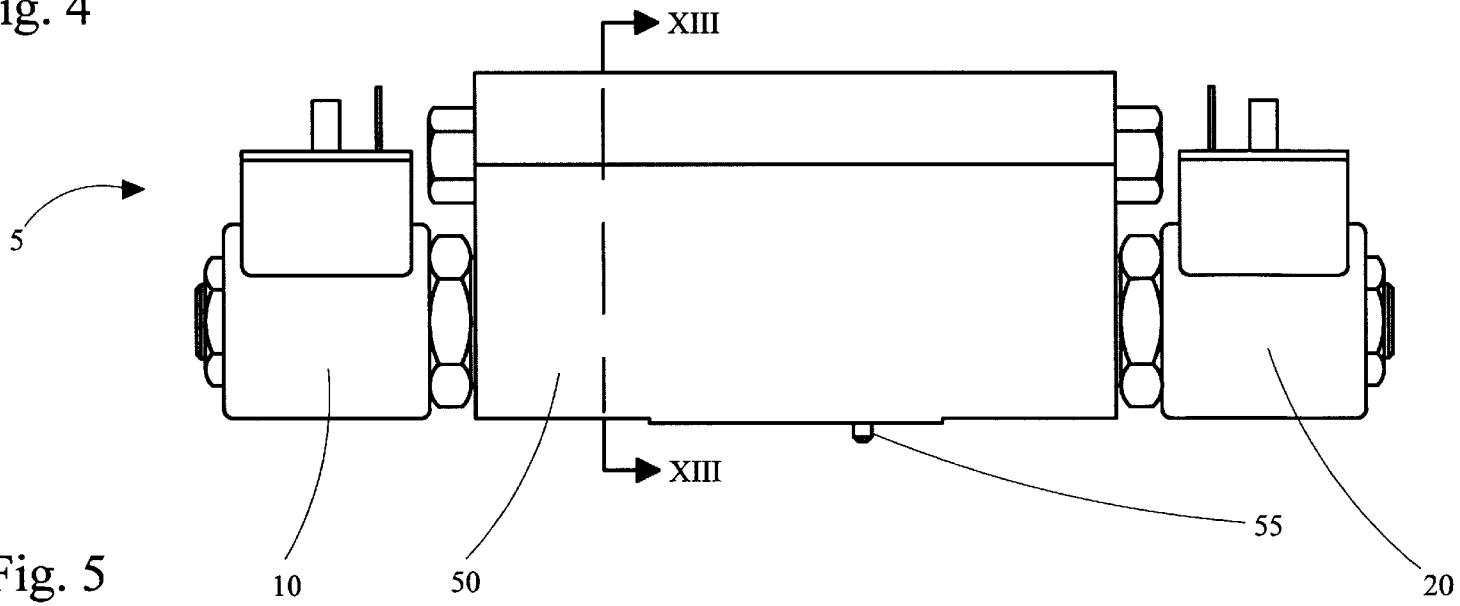
FIG. 5 shows a front elevation view of the valve of the present invention.
Figure 6:
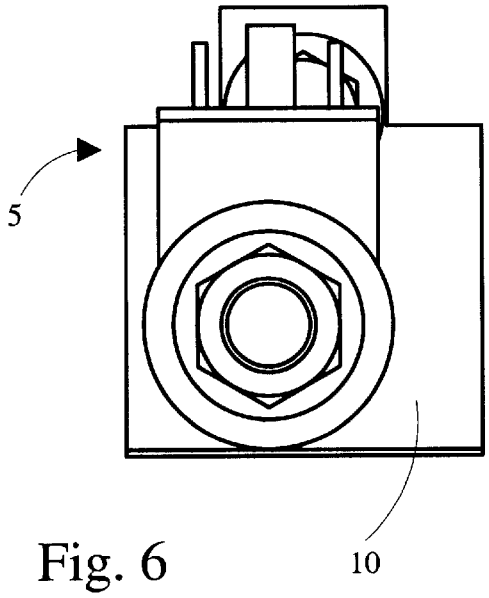
FIG. 6 shows a left side elevation view of the valve of the present invention.

When the solenoid of second valve 20 is energized and the solenoid of first valve 10 is de-energized, valve 20 opens. Port P is thereby connected to port B, while the flow from port B to tank port T is blocked by POCV 40 as valve 10 returns to its normally closed position. The pressure from the pressurized B-line opens POCV 30 via pilot port 34, thereby connecting the A-line to tank. As before, if power fails, pressure is maintained in the B-line while the A-line is connected to tank. The simplified schematic for directional control valve 5 is shown in FIG. 2.

Without optional check valve 8 installed, valve 5 is only electrically fail-safe. That is, if electric power is lost to either energized solenoid valve, first and second valves 10, 20 do not move. The inclusion of check valve 8 at the P-port makes valve 5 also fail-safe should there be a loss of hydraulic pressure at the P-port. This double fail-safe feature of valve 5, while being useful for situations where an unanticipated loss of either electrical or hydraulic power must be guarded against, permits applications that intentionally shut off power to both the valve and the pump. The experimental leakage rate of valve 5 is five drops per minute at 6,000 psi (408 bar), so valve 5 maintains its clamp pressure for an extended period of time.

Referring to FIGS. 3–6, a body 50 of valve 5 is preferably bolted to a baseplate (not shown). Although this embodiment shows a subplate mounted valve according to the international standard DO3 pattern, the valve of the present invention is easily adaptable to other mounting configurations. Body 50 is preferably of 7075-T651 extruded aluminum. Body 50 includes a plurality of through holes 54 for receiving the bolts (not shown). Body 50 further includes ports A, B, P, and T. Valves 10 and 20 connect to the ends of body 50. Typical weight and dimensions of valve 5 are 3.0 lbs (1.4 kg), 8.19 inches (208.0 mm) long (including valves 10, 20), 2.38 (60.5 mm) inches high, and 1.88 inches (47.8 mm) wide. This narrow width allows for mounting multiple valves on standard 2.00 inch (50.8 mm) centers. An orientation pin 55 is required to meet the DO3 standard, but is otherwise optional.

Figure 7:
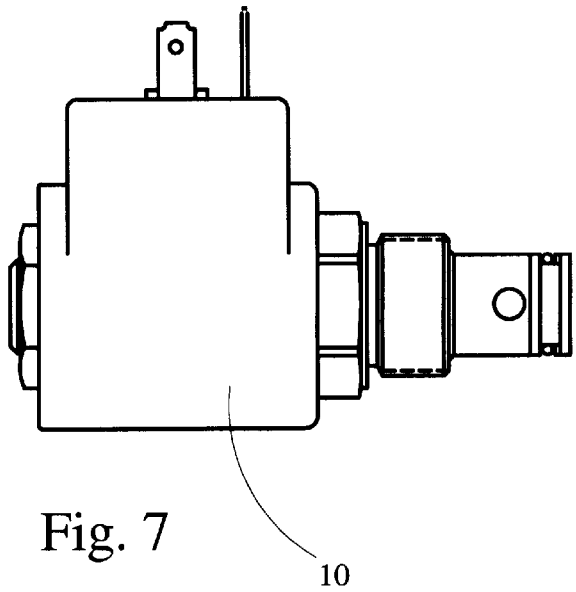
FIG. 7 shows a side view of a normally closed 2-way poppet solenoid valve used in the valve of the present invention.

Referring to FIG. 7, valve 10 is shown as it appears before being fitted into body 50. Valves 10 and 20 are preferably spring offset solenoid operated 2-way poppet (zero-leak) valves that are normally closed, such as the HydraForce SL08-22.

Figure 8:
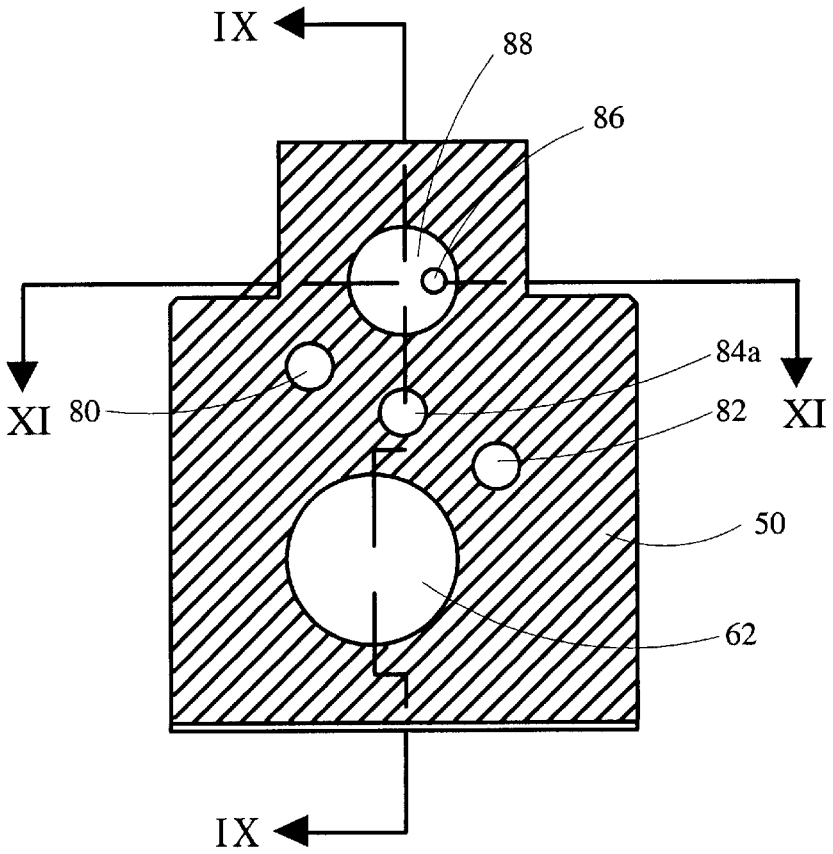
FIG. 8 shows a cross-section of a body of the valve of the present invention taken along the line VIII—VIII in FIG. 5.

Referring to FIG. 8, a cross-section of body 50 taken near an end that first valve 10 connects with shows a cavity 62 for receiving first valve 10. A cavity 88 receives first POCV valve 30. A drilled hole 86 connects with the B-line of valve 5; a drilled hole 80 connects with the T-line; a drilled hole 84*a* connects with the A line; and a drilled hole 82 connects with the P-line. A cross-section taken at the other end of body 50 would show a drilled hole connecting to the A-line instead of the B-line and a drilled hole connecting to the B-line (reference numeral 84*b* in FIG. 9A) instead of the A-line.

Figures 9A, 9B:
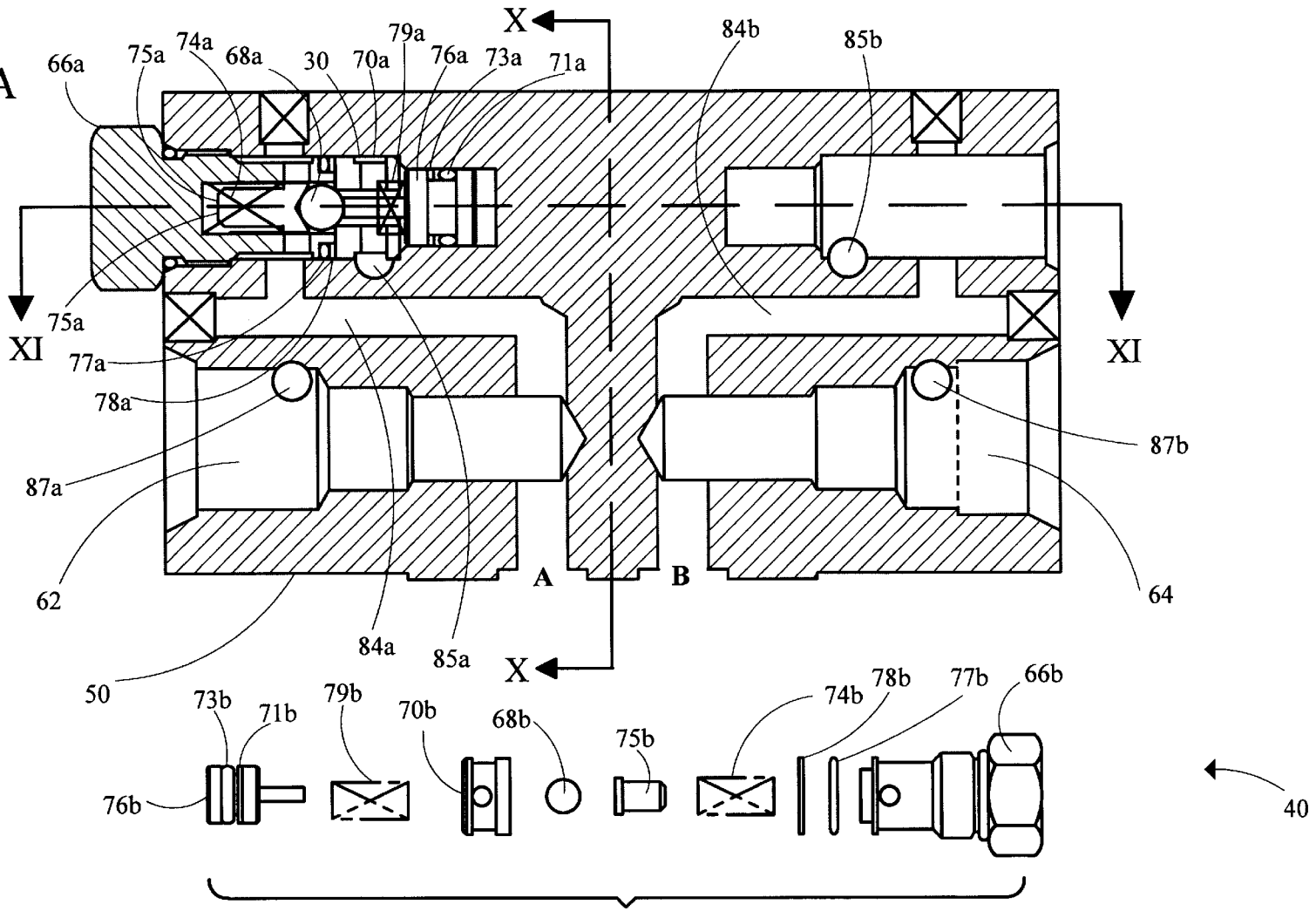
FIG. 9A shows a cross-section of the body of the valve of the present invention taken along the line IX—IX in FIG. 8.
FIG. 9B shows an exploded view of a pilot operated check valve incorporated in the valve of the present invention.

Referring to FIGS. 9A–9B, body 50 includes cavity 62 for receiving valve 10 and a cavity 64 for receiving valve 20. Since first and second POCVs 30, 40 are identical, the exploded view of FIG. 9B is used to describe the POCVs used. Reference to the elements of second POCV 40 should be considered to refer also to the elements of POCV 30. A plug 66*b* of POCV 40 holds POCV 40 in body 50. A poppet 68*b* is contained within a seat 70*b*, where a spring 74*b* and a spring follower 75*b* hold the check valve in a normally closed position. An additional spring 79*b* is preferable to ensure proper operation of POCV 40. O-rings 73*b*, 77*b* and backup rings 71*b*, 78*b* ensure leak-proof operation. A pilot piston 76*b* controls the operation of POCV 40. Poppets 68*a*, 68*b* and seats 70*a*, 70*b* are preferably of hardened and ground steel. O-rings 73*a*, 73*b*, 77*a*, 77*b* are preferably of polyurethane while backup rings 71*a*, 71*b*, 78*a*, 78*b* are preferably of Teflon.

During operation, when the solenoid of second valve 20 is energized and the solenoid of first valve 10 is de-energized, valve 20 opens and valve 10 closes. The open position for valve 20 is shown by the dashed line in cavity 64. The P-line at a cross-hole 87*b* is thereby connected to the B-line, while the flow from the B-line at 84*b* to the T-line is blocked by POCV 40 as valve 10 returns to its normally closed position as the A-line pressure to the pilot port of POCV 40 diminishes. The pressure from the pressurized B-line (shown in FIG. 11) opens POCV 30, thereby connecting the A-line of 84*a* to the T-line at a cross-hole 85*a*. If power fails, pressure is maintained in the B-line while the A-line is connected to the T-line. First valve 10 functions in similar fashion.

Figure 10:
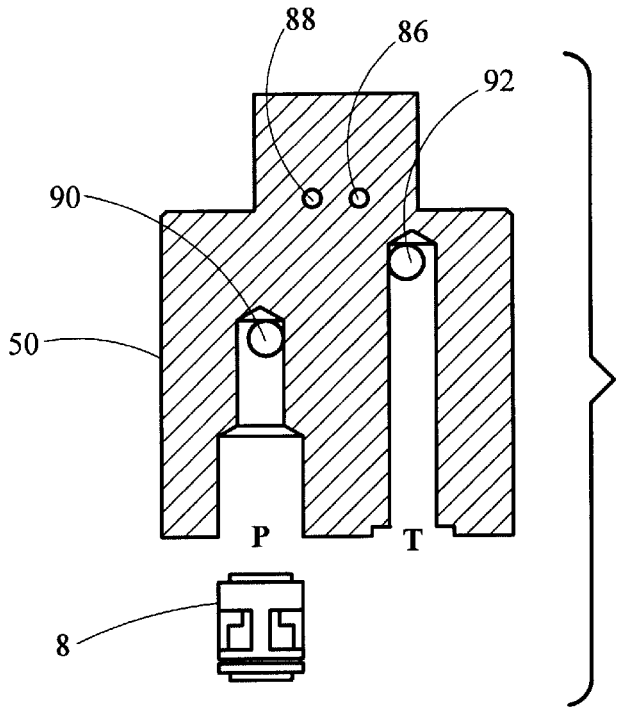
FIG. 10 shows a cross-section of the body of the valve of the present invention taken along the line X—X in FIG. 9A.
Figure 11:
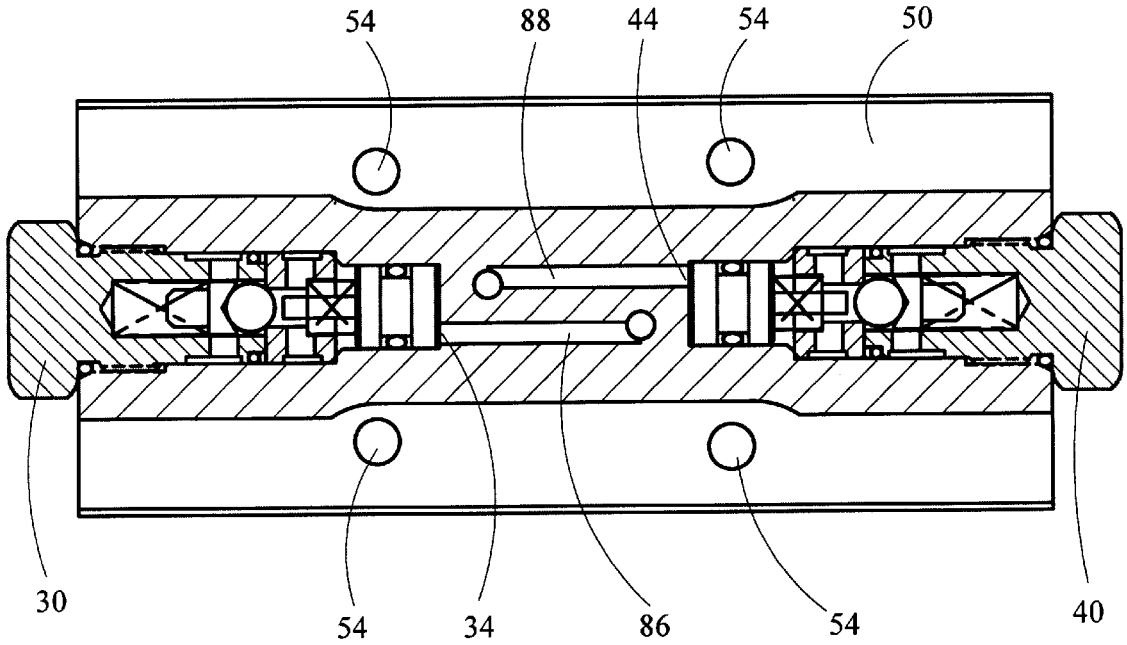
FIG. 11 shows a cross-section of the body of the valve of the present invention taken along the line XI—XI in FIG. 8.

Referring to FIGS. 10–11, the offset arrangement of the horizontal A-line at 88 and the horizontal B-line at 86 are shown. Line 88 brings A-line pressure to pilot port 44 of second POCV 40, while line 86 brings B-line pressure to pilot port 34 of POCV 30. FIG. 10 also shows optional check valve 8, as well as horizontal cross holes 90 and 92 for P and T, respectively.

Figure 12:
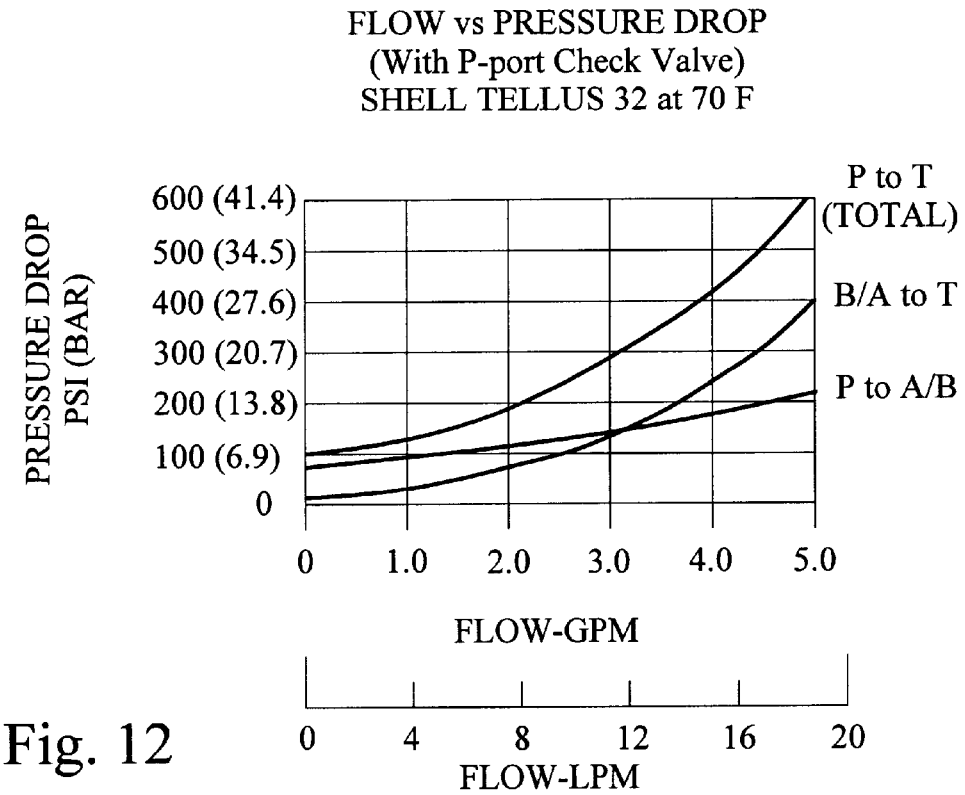
FIG. 12 shows the flow versus pressure drop graph for the valve of the present invention.

Referring to FIG. 12, the flow versus pressure drop graph is shown for valve 5. Valve 5 has a high flow of 3.0 gpm (11.4 lpm) nominal.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A four-way hydraulic directional control valve, comprising:

a) a valve body having a pressure supply port, a tank port, and first and second load ports;

b) first and second normally-closed 2-way poppet solenoid zero-leakage valves mounted to said valve body;

c) first and second normally-closed zero-leakage pilot-operated check valves mounted within said valve body;

d) said pressure supply port being directly connected to both an inlet port of said first poppet solenoid valve and an inlet port of said second poppet solenoid valve;

e) said first load port being directly connected to an outlet port of said first poppet solenoid valve and said second load port being directly connected to an outlet of said second poppet solenoid valve;

f) said first load port being directly connected to a checked port of said first check valve and said second load port being directly connected to a checked port of said second check valve; and g) said first load port being directly connected to a pilot port of said second check valve and said second load port being directly connected to a pilot port of said first check valve.

2. An apparatus according to claim 1, further comprising a pressure port check valve connected to said pressure supply port.

3. An apparatus according to claim 1, wherein said first and second check valves each comprise:

a plug element;

a poppet contained within a seat;

a first spring and spring follower between said poppet and said plug element;

a pilot piston; and a second spring between said pilot piston and said seat.

4. A four-way hydraulic directional control valve, comprising:

a valve body having a pressure supply port, a tank port, and first and second load ports;

first and second normally-closed 2-way poppet solenoid zero-leakage valves mounted to said valve body and having means for energizing said solenoids;

first and second normally-closed zero-leakage pilot-operated check valves mounted within said valve body;

means for maintaining pilot pressure to an inactive pilot side of each pilot-operated check valve such that when electrical power is lost following actuation of one of said solenoid valves, one load port remains pressurized and the other load port remains open to tank;

means for directing supply pressure from an output port of said first solenoid zero-leakage valve to said first load port while said second load port is connected to said tank port;

means for directing supply pressure from an output port of said second solenoid zero-leakage valve to said second load port while said first load port is connected to said tank port; and means for providing zero internal leakage in each of first, second, and third positions of said first and second solenoid zero-leakage valves wherein in said first position, said first solenoid zero-leakage valve is energized; in said second position, said second solenoid zero-leakage valve is energized; and in said third position, said first and second solenoid zero-leakage valves are de-energized.

5. A valve according to claim 4, further comprising:

means for maintaining pressure at said first load port when said second load port remains connected to said tank port; and means for maintaining pressure at said second load port when said first load port remains connected to said tank port;

wherein, when an actuator is connected to said first and second load ports, a position of said actuator remains unchanged during a momentary or prolonged loss of supply pressure, regardless of an electrical state of said first and second solenoid zero-leakage valves.

* * * * *